US005160944A

United States Patent [19]

Fukumoto et al.

[11] Patent Number: 5,160,944

[45] Date of Patent: Nov. 3, 1992

[54] THERMAL PRINTER WITH ANTI-SLIP SHEET CONVEYING MECHANISM

[75] Inventors: Hiroshi Fukumoto; Koji Namura, both of Hyogo; Hisashi Nakamura, Hiroshima; Keiichi Fukazawa, Hiroshima; Kenichi Naruki, Hiroshima, all of Japan

[73] Assignee: Mitsubishi Denki Kabushiki Kaisha, Japan

[21] Appl. No.: 683,819

[22] Filed: Apr. 11, 1991

[30] Foreign Application Priority Data

Apr. 27, 1990 [JP] Japan ..... 2-114300

[51] Int. Cl.[5] ..... B41J 2/325; B41J 11/00

[52] U.S. Cl. ..... 346/76 PH; 346/134; 400/120; 400/611; 400/612; 400/618; 400/578

[58] Field of Search ..... 346/76 PH, 134, 136; 400/120, 618, 578, 611, 612

[56] References Cited

U.S. PATENT DOCUMENTS

| | | | |
|---|---|---|---|
| 4,642,659 | 2/1987 | Nagashima et al. | 346/76 PH |
| 4,829,320 | 5/1989 | Une et al. | 346/76 PH |
| 4,838,719 | 6/1989 | Une | 400/618 |
| 4,910,530 | 3/1990 | Fukumoto et al. | 346/76 PH |
| 4,985,711 | 1/1991 | Nakamura et al. | 346/76 PH |

FOREIGN PATENT DOCUMENTS

| | | | |
|---|---|---|---|
| 0294946 | 12/1988 | European Pat. Off. . | |
| 3825752 | 2/1989 | Fed. Rep. of Germany . | |
| 0063463 | 4/1986 | Japan | 346/76 PH |
| 0224978 | 9/1988 | Japan . | |
| 2207886A | 2/1989 | United Kingdom . | |

OTHER PUBLICATIONS

"The Rolling Contacts of Two Elastic-Layer-Covered Cylinders Driving a Loaded Sheet in the NIP", Journal of Applied Mechanics, Dec. 1981, vol. 48, pp. 889-894.

"The Steady Rolling Contact of Two Elastic Layer Bonded Cylinders with a Sheet in the NIP", International Journal of Journal of Mechanical Science, vol. 53, pp. 263-273, 1981.

*Primary Examiner*—Benjamin R. Fuller
*Assistant Examiner*—Huan Tran
*Attorney, Agent, or Firm*—Leydig, Voit & Mayer

[57] ABSTRACT

A thermal printer includes a platen roller on which a recording sheet is wound in such a manner that the recording sheet is laid over a part of the cylindrical wall of the platen roller. A thermal head is pushed against the platen roller to heat heating points selected for transferring ink from an ink sheet onto the recording sheet. A sheet pulling means pulls the recording sheet in a predetermined direction. A pinch roller on the sheet supplying side pushes the recording sheet against the platen roller with a predetermined force of depression so that the recording sheet is wound on the platen roller. A pinch roller rotating means is provided at at least one end of the pinch roller for rotating the pinch roller at a peripheral speed lower than that of the platen roller.

2 Claims, 4 Drawing Sheets

THERMAL PRINTER WITH ANTI-SLIP SHEET CONVEYING MECHANISM

BACKGROUND OF THE INVENTION

This invention relates to the recording sheet conveying mechanism of a thermal printer.

FIGS. 8 and 9 are a perspective view and a side view of the recording sheet conveying mechanism in a conventional thermal printer. Recording sheets 30 are supplied from a sheet supplying mechanism 15 one at a time. The front edge portion of each sheet 30 thus supplied is inserted into a clamper 10. Under this condition, the clamper 10 is closed by means of a clamper closing mechanism 16, so that the recording sheet is held by the clamper. The clamper 10 is mounted, on a bridge 10*a* both ends of which are mounted on a pair of endless timing belts 3 in such a manner that the clamper is in parallel with a platen roller 1. A first pair of pulleys 2 are mounted on the shaft of the platen roller 1 in such a manner that they are rotatable around the shaft of the platen roller. A second pair of pulleys 4 are driven through a torque limiter 13 by a second motor 12. Hence, the timing belts 3 are driven by the second pair of pulleys 4, and the clamper 10 is moved in the direction of the arrow B as the timing belts are driven. The speed of movement of the clamper 10 is determined from the number of revolutions per unitary time $N_2$ of the second pair of pulleys 4 (hereinafter referred to as "the speed of rotation or merely speed $N_2$", when applicable). The speed $N_2$ of the second pulleys 4 has been determined from the constant speed M of the second motor 12 unless the torque limiter suffers from slip.

The clamper 10 thus moved is returned to its initial position passing through the first pair of pulleys 2, the second pair of pulleys 4 and a third pair of pulleys 5. In this operation, the recording sheet held by the clamper 10 is pushed against the platen roller 1 by a thermal head 9 so that the color of an ink sheet adapted to supply a printing color agent is transferred onto the recording sheet. In a color printing operation, the above-described color transferring operation is repeated three or four times using ink sheets different in color. In this case, the recording sheet is caused to move over the pulleys 2, 4 and 5 three or four times.

In the color transferring operation; i.e., in the printing operation, the nip region of the thermal head 9 which is in contact with the recording sheet 30 is pushed against the platen roller 1 by a force $P_H$ (cf. FIG. 3). Hence, the recording sheet 30 is conveyed as the platen roller 1 is rotated by a first motor 11; that is, the recording sheet 30 is conveyed at a constant speed $V_1$ which is determined from the speed of the platen roller 1, and accordingly the clamper 10 holding the recording sheet is also moved at the same speed $V_1$.

During printing, the speed of movement of the recording sheet or clamper is $V_1$, as was described above. When the recording sheet 30 is not printed; i.e., when it is not pushed by the nip region of the platen roller through the nip region (hereinafter referred to as "an idle movement period", when applicable), the speed of movement of the clamper is $V_2$.

The speed of movement $V_2$ is set to a value higher than the recording sheet conveyance speed $V_1$. The difference between the two speeds $V_1$ and $V_2$ is absorbed by the slip of the torque limiter 13. That is, for the printing period, the speed of movement of the clamper 10 and the timing belts 3 is equal to the sheet conveying speed $V_1$, and the second pair of pulleys are rotated at the speed of rotation $N_1$ corresponding to the sheet conveyance speed $V_1$. The speed of rotation $N_1$ of the second pulleys is lower than that $N_2$ in the idle movement period in which the recording sheet is not printed. Therefore, the difference between the speed of rotation of the second pair of motor to rotate the second pulleys at the speed of rotation $N_2$ at all times and the actual speed of rotation $N_1$ of the second pulleys is absorbed by the slip of the torque limiter 13. In this slip, the torque predetermined by the torque limiter 13 is applied through the second pair of pulleys 4 and the timing belts 3 and 3 to the clamper 10. Accordingly, during printing, the clamper 10 draws the recording sheet 30 with a tensile force corresponding to the predetermined torque.

If the recording sheet conveyance speed changes during printing, then in the case of a color printing operation an undesirable color shifting phenomenon occurs. Hence, it is one of the most important conditions for a thermal printer to maintain the recording sheet conveyance speed during printing. During printing, the recording sheet conveyance speed depends on the nip region X of the thermal head 9 and the platen roller 1.

In the conventional thermal printer constructed as described above, the tensile force acting on the recording sheet may change because of the following reasons:

The output torque of the torque limiter 13 changes, which applies the tensile force to the recording sheet 30. This change is unavoidable because it is due to the operating principle of the torque limiter 13. At the nip region X, both the recording sheet 30 and an ink sheet 6 are conveyed. Thereafter, the recording sheet and the ink sheet are separated from each other. The force of separating the recording sheet 30 and the ink sheet from each other depends on the printing density of the thermal head; that is, the tensile force applied to the recording sheet is affected thereby.

The width of variation of the tensile force is, in general, smaller than the frictional force acting on the recording sheet at the nip region X (that is, the width of variation of the tensile force is not so large as to allow the recording sheet to slip through the nip region X. However, it should be noted that, for instance in the case where the tensile force increases in the direction of conveyance of the recording sheet, the recording sheet conveyance speed at the nip region increases with the variation of the tensile force. In the case where, on the other hand, the tensile force decreases in the direction of conveyance, the recording sheet conveyance speed at the nip region X decreases. In short, slip occurs between the recording sheet 30 and the nip region X of the platen roller, to change the speed in the above-described manner. This fact has been theoretically proven as indicated in FIG. 3 of the publication "The Rolling Contacts of Two Elastic-Layer-Covered Cylinders Driving a Loaded Sheet in the Nip" T.-C. Soong et al Transactions of the ASME (American Society of Mechanical Engineers) Journal of Applied Mechanics December, 1981, vol 48, pp 889–894 (hereinafter referred to as "Literature 1".

As was described above, in the conventional thermal printer, the speed of conveyance of a recording sheet 30 changes, even though it should be maintained constant.

SUMMARY OF THE INVENTION

Accordingly, an object of this invention is to eliminate the above-described difficulty accompanying a conventional thermal printer. More specifically, an object of the invention is to provide a thermal printer in which the recording sheet conveyance speed is maintained constant during printing.

A thermal printer according to the invention comprises a platen roller on which a recording sheet is wound in such a manner that the recording sheet is, laid over an angular part of the cylindrical wall of the platen roller, the platen roller conveying the recording sheet in a predetermined direction, a thermal head pushed against the platen roller to heat points selected for transferring ink from an ink sheet onto the recording sheet; sheet pulling means for pulling the recording sheet in the predetermined direction, a pinch roller on the sheet supplying side for pushing the recording sheet against the platen roller with a predetermined force of depression so that the recording sheet is wound on the platen roller, and pinch roller rotating means provided at at least one end of the pinch roller for rotating the pinch roller at a peripheral speed lower than that of the platen roller.

In the thermal printer of the invention, the pinch roller on the sheet supplying side pushed against the platen roller through the recording sheet is rotated at a speed lower than that of the platen roller during printing while the sheet is being pulled in the direction of conveyance. Hence, the recording sheet is conveyed while being in close contact with the relatively large angular part of the cylindrical wall of the platen roller from the nip region of the pinch roller and the platen roller to the nip region of the thermal head and the platen roller.

DETAILED DESCRIPTION OF THE PREFERRED EMBODIMENT

Figure 1:
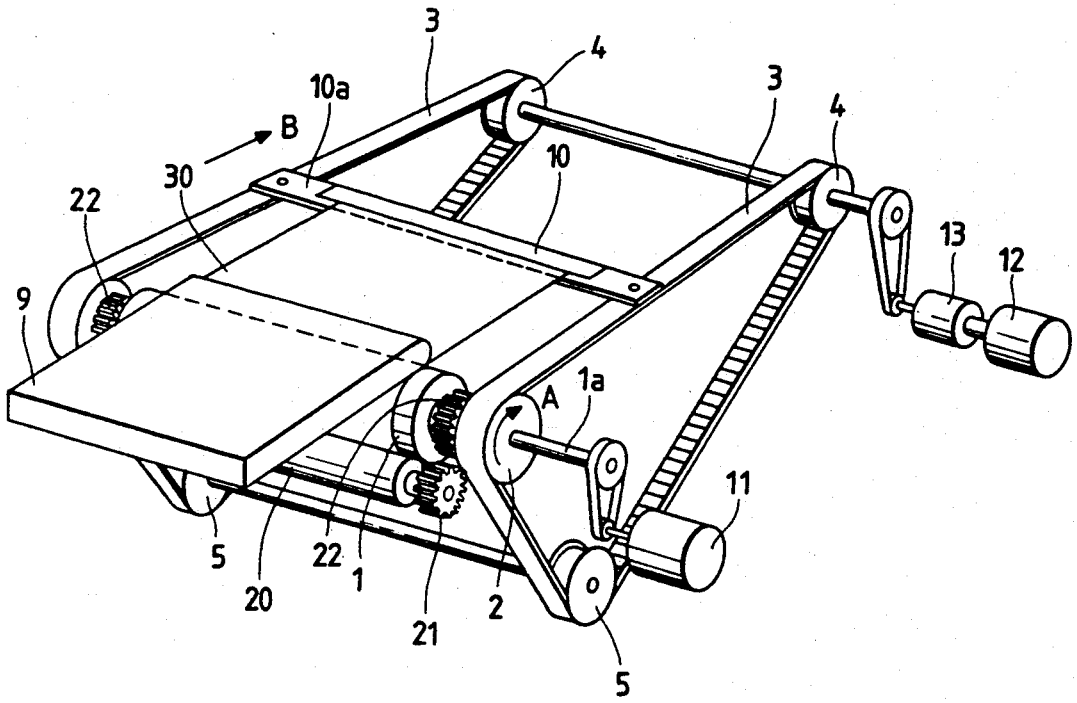
FIGS. 1 and 2 are a perspective view and a side view, respectively, showing essential components of a thermal printer embodying this invention.
Figure 2:
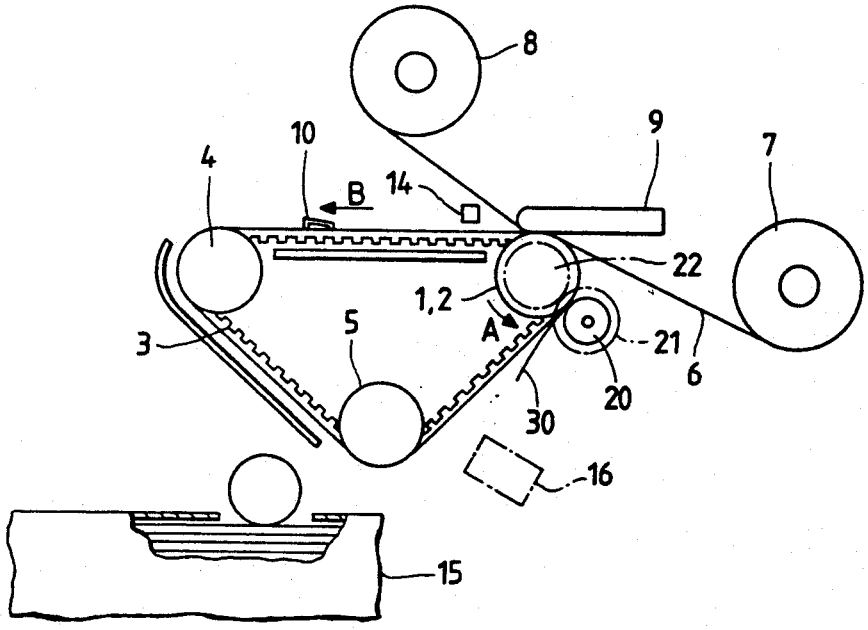

FIGS. 1 and 2 are a perspective view and a side view, respectively, showing essential components of a thermal printer embodying the invention, which is performing a printing operation.

As shown in these figures, a pair of right and left timing belts 3 are laid over first pair of pulleys 2, a second pulleys 4 and 4, and third pulleys 5 and 5 under tension. The first pair of pulleys 2 are mounted on the shaft la of a platen roller 1 in such a manner that they are rotatable around the shaft 1*a*. Both ends of a bridge 10*a* are connected to timing belts 3 in such a manner that the bridge 10*a* is in parallel with the platen roller 1. A clamper 10 is mounted on the bridge 10*a*. A thermal head 9 is so installed that it is brought into contact with and moved away from the platen roller by a mechanism (not shown). An ink sheet 6 is supplied from an ink sheet supplying reel 7. The ink sheet 6 thus supplied is passed through the gap between the platen roller 1 and the thermal head 9, and then wound on a take-up roll 8.

The platen roller 1 is driven by a first motor 11. The second pair of pulleys 4 are driven by a second motor 12 through a torque limiter 13. Hence, the timing belts 3 are driven by the second pulleys 4, and the clamper 10 is moved with the timing belts 3 at a speed $V_2$ in the direction of the arrow B. The speed of movement $V_2$ of the clamper 10 depends on the speed of rotation $N_2$ of the second pair of pulleys 4. The speed of rotation $N_2$ is determined from the predetermined speed of rotation M of the second motor 12 unless slip occurs with the torque limiter 13.

A pinch roller 20 is mounted in such a manner that it is moved into or out of engagement with the platen roller 1 by a mechanism (not shown). During printing, the pinch roller 20 is urged against a recording sheet 30 and the platen roller 1 with a predetermined force $P_B$ (cf. Fig, 3) described later. Since the pinch roller 20 is urged in this manner, the recording sheet 30 is wound on the platen roller 1. The pinch roller 20 has a first pair of gears 21, are at each end. The platen roller 1 has a second pair of gears 22, and one at each end, which are engaged with the first pair of gears 21 of the pinch roller 20 so that rotation of the platen roller 1 is transmitted to the pinch roller 20. The first and second gears 21 and 22 form a rotation transmitting system, in which the gear ratio is so determined that the peripheral speed of the pinch roller 20 is lower than that of the platen roller 1.

Now, the operation of the thermal printer thus constructed will be described.

Before the start of a printing operation, the clamper 10 is held above a clamper closing mechanism 16. When the front edge portion of a recording sheet 30 supplied from a sheet supplying mechanism 15 is inserted into the pawl of the clamper 10, the clamper closing mechanism 16 operates to close the clamper 10, so that the clamper 10 holds the front edge portion of the recording sheet. Under this condition, the platen roller 1 is rotated in the direction of the arrow A. In this case, the pinch roller 20 and the thermal head 9 are held spaced away from the platen roller 1. Therefore, together with the timing belts 3 the clamper 10 holding the recording sheet 30 is moved passing through the space between the pinch roller 20 and the platen roller 1 and the space between the platen roller and the thermal head 9, thus reaching a sheet detecting sensor 14. Upon detection of the front edge of the recording sheet 30 by the sheet detecting sensor 14, the pinch roller 20 and the thermal head 9 are pushed against the platen roller 1, so that a printing operation is started.

Figure 3:
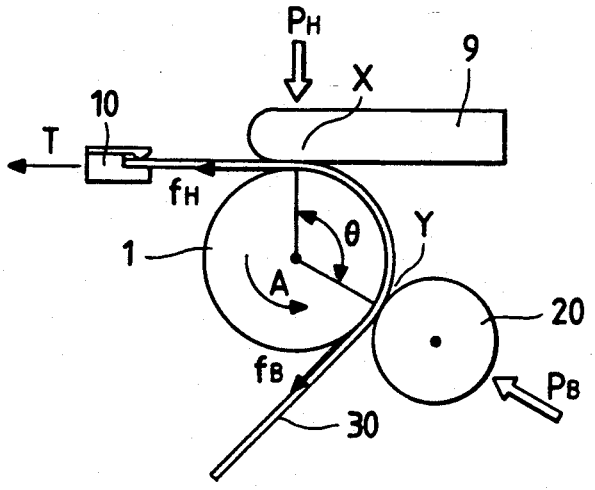
FIG. 3 is a theoretical diagram showing forces applied to a recording sheet during printing.

FIG. 3 theoretically shows forces applied to the recording sheet 30 during printing.

In FIG. 3, the thermal head 9 pushes the platen roller 1 at the nip region X through the recording sheet 30 with a force $P_H$. Since, under this condition, the platen 1 is rotated in the direction of the arrow A by the first motor 11, the nip region X, the thermal head 9, and the platen roller 1 together form a first recording sheet conveying section. Similarly, the pinch roller 20 urges the platen roller 1 at a nip region Y against the recording sheet 30, and, since, under this condition the platen roller 1 is rotated in the direction of the arrow A, the nip region Y, the pinch roller 20, and the platen roller 1 together forms a second recording sheet conveying section.

It is assumed that the first recording sheet conveying section with the nip region X and the second recording sheet conveying section Y convey the recording sheet independently of each other, and that their recording sheet conveyance speeds are represented by $V_H$ and $V_B$. When the following relation (1) is established, the recording sheet can be brought into close contact with the relatively larger part (X−Y) of the outer cylindrical surface of the platen roller:

$$V_H > V_B \quad (1)$$

This relatively large part provides a third recording sheet conveying section (hereinafter referred to as "a third recording sheet conveying section X-Y"). The recording sheet conveying section X-Y is much wider than the recording sheet conveying section provided by the nip region of the platen roller in the conventional thermal printer. Therefore, even if the tensile force T applied to the recording sheet changes, the recording sheet conveyance speed is scarcely affected thereby. The tensile force is described in the introductory part of the specification.

Figure 4:
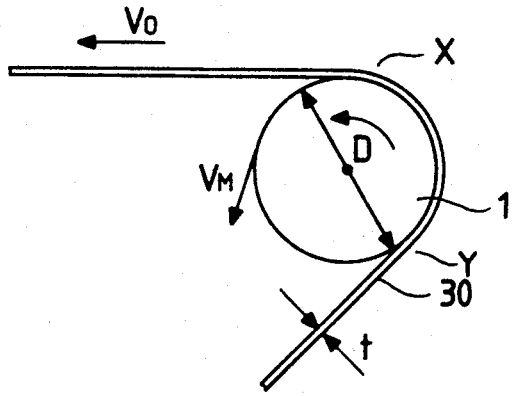
FIG. 4 is a theoretical diagram showing the general relationships between a platen roller and a recording sheet.

When the recording sheet 30 is wound on the platen roller 1 by a certain tensile force as shown in FIG. 4, the recording sheet conveyance speed $V_0$ of the third recording sheet conveying section X-Y can be represented by the following equation if there is no slip between the platen roller 1 and the recording sheet 30:

$$V_0 = (1 + t/D)V_M$$

where t is the thickness of the recording sheet 30, D is the diameter of the platen roller and $V_M$ is the peripheral speed of the platen roller 1 which is represented by $V_M = w\ D/2$ in which w is the angular speed.

The conveyance speed $V_0$ is constant because the recording sheet winding region X-Y is not deformed by external force.

Figure 5:
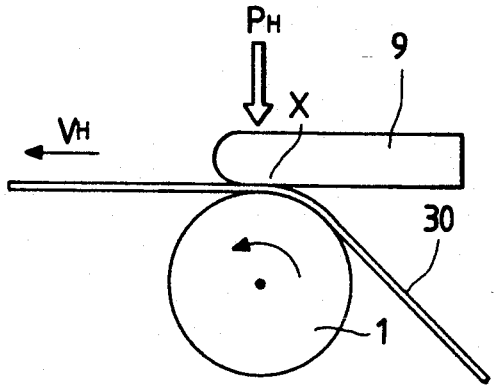
FIG. 5 is a theoretical diagram showing the general relationships between a platen roller, a recording sheet and a thermal head.

On the other hand, as shown in FIG. 5, the platen roller 1 is deformed at the nip region X by the force of depression $P_H$ of the thermal head 9, and accordingly the recording sheet conveyance speed $V_H$ at the nip region X is different from the speed $V_0$. The conveyance speed $V_H$ is, in general, higher than $V_0$ because of the deformation of the platen roller 1, for instance. That is, the following relationship (2) is established:

$$V_H > V_0 \quad (2)$$

This fact has been confirmed analytically as is seen from FIG. 2 in the publication "THE STEADY ROLLING CONTACT OF TWO ELASTIC LAYER BONDED CYLINDERS WITH A SHEET IN THE NIP" by Tsai-Chen Soong et al. Int. J. Mech. Sci. vol. 23, pp 263–273, 1981 printed in Great Britain (hereinafter referred to as "Literature 2".) It goes without saying that the recording sheet conveyance speed $V_H$ is affected by the force of depression of the thermal head 9.

Figure 6:
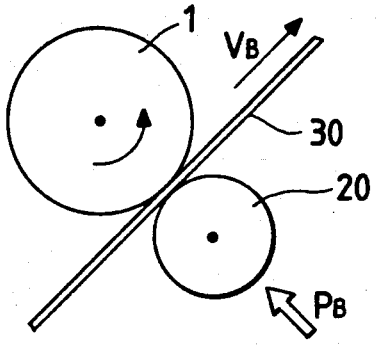
FIG. 6 is a theoretical diagram showing the general relationships between a platen roller, a recording sheet and a pinch roller.

In the case of FIG. 6, the pinch roller 20 urges the platen roller 1 at the nip region Y against the recording sheet 30. In this case, the recording sheet conveyance speed $V_B$ of the second recording sheet conveying section with the nip region Y is affected by the force of depression of the pinch roller 20, and, as was described before, the peripheral speed of the pinch roller 20 is lower than that of the platen roller 1. In this connection, the material of the pinch roller 20 is so selected that the frictional coefficient between the recording sheet and the pinch roller is smaller than the frictional coefficient $\mu$ between the recording sheet and the platen roller, as a result of which slip occurs only between the pinch roller 20 and the recording sheet 30. Accordingly, the frictional force acts on the recording sheet 30 in the direction opposite to the direction of conveyance. That is, the frictional force acts as a tensile force to pull the recording sheet backwardly. Thus, similarly as in the relation between the tensile force variation and the conveyance speed described in the introductory part of the specification, the recording sheet conveyance speed $V_B$ of the second recording sheet conveying section with the nip region Y is lower than $V_0$. That is, $$V_0 > V_B \quad (3)$$

From the above-described relations (2) and (3), the relations among the conveyance speeds of the conveying sections are $V_H > V_0 > V_B$, thus satisfying the above-described relation (1). That is, the platen roller 1, the thermal head 9 and the pinch roller 20 form, in combination, the recording sheet conveying section X-Y which is of considerable size, extending between the nip regions X and Y.

As is apparent from the above description, the recording sheet 30 is conveyed by the large part (X−Y) of the cylindrical wall of the platen roller at the speed $V_0$. Hence, at the first recording sheet conveying section with the nip region X, the force induced by the difference between the recording sheet conveyance speed $V_H$ and the conveyance speed $V_0$ acts on the recording sheet 30, while at the second recording sheet conveying section with the nip region Y, the force induced by the difference between the recording sheet conveyance speed $V_B$ and the conveyance speed $V_0$ acts on the recording sheet 30. That is, as shown in FIG. 3, a force $f_H$ is induced at the first recording sheet conveying section having the nip region X, acting on the recording sheet 30. Since the speed difference $V_H - V_0$ is positive, the direction of the force $f_H$ coincides with the recording sheet conveyance direction. At the same time, a force $f_B$ is indicated at the second recording sheet conveying section with the nip region Y. Since the speed difference $V_B - V_0$ is negative, the direction of the force $f_B$ is opposite to the recording sheet conveyance direction. In this case, similarly as in the case of the conventional thermal printer, the tensile force T is applied to the recording sheet 30 in the recording sheet conveyance direction by the clamper 10.

Figure 7:
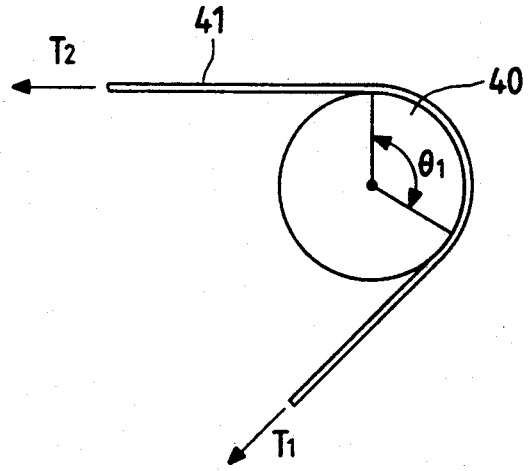
FIG. 7 is a theoretical diagram showing the relationships between a cylinder and a flexible element.
Figure 8:
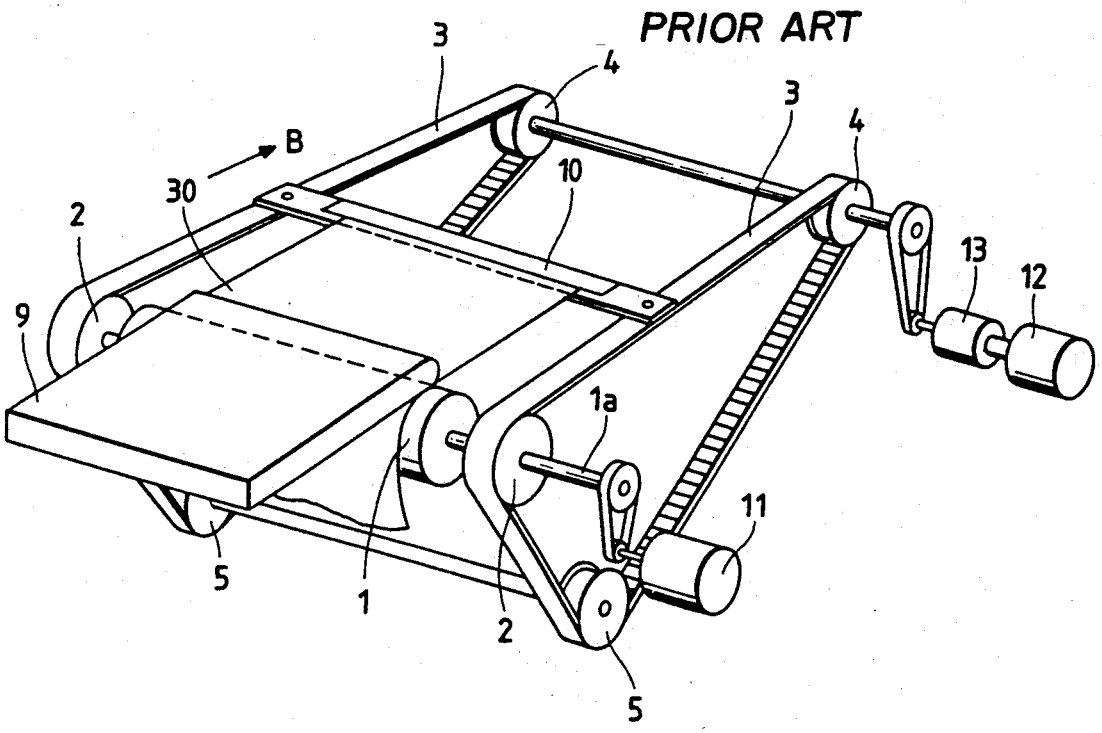
FIG. 8 PRIOR ART
FIGS. 8 and 9 are a perspective view and a side view, respectively, showing essential components of a conventional thermal printer.
Figure 9:
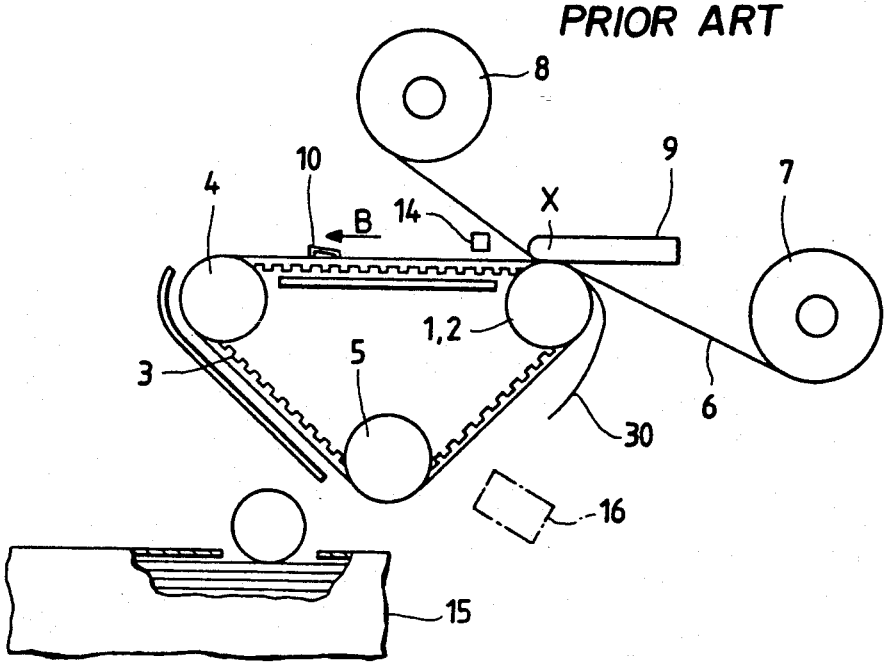
FIG. 9 PRIOR ART

Let us consider the case where, as shown in FIG. 7, a flexible element 41 such as a sheet of paper is wound on a fixed rigid cylinder 40 with a winding angle $\theta_1$. If, in this case, tensile forces $T_1$ and $T_2$ act on the flexible element 41 with a frictional coefficient $\mu_1$ between the flexible element 41 and the outer cylindrical wall of the cylinder 40, then the following relations are established:

(i) When $T_1 > T_2 e^{\mu 101}$, the flexible element 41 slides on the cylindrical wall of the cylinder 40 in the direction of the tensile force $T_1$.

(ii) When $T_1 < T_2/e^{\mu 101}$, the flexible element 41 slides on the cylindrical wall of the cylinder 40 in the direction of the tensile force $T_2$.

(iii) When $T_2/e^{\mu 101} < T_1 < T_2 e^{\mu 101}$, the flexible element 41 will not slide, being caught by the cylindrical wall of the cylinder 40.

The flexible element 41 and the cylinder 40 in FIG. 7 correspond to the recording sheet 30 and the platen roller 1 in FIG. 3, respectively. The constants $\mu_1$, $\theta_1$, $T_1$ and $T_2$ in FIG. 7 correspond to the following constants in FIG. 3:

(1) The frictional coefficient $\mu_1$ between the flexible element 41 and the cylindrical wall of the cylinder 40 corresponds to the frictional coefficient $\mu$ between the recording sheet 30 and the platen roller 1.

(2) The winding angle $\theta_1$ of the flexible element 41 on the cylinder 40 corresponds to the winding angle $\theta$ of the recording sheet 30 on the platen roller 1.

(3) The tensile force $T_1$ applied to the flexible element 41 corresponds to the force $f_B$ acting on the recording sheet 30.

(4) The tensile force $T_2$ applied to the flexible element 41 corresponds to the force $(T+f_H)$ acting on the recording sheet 30.

Accordingly, the above-described cases (i), (ii) and (iii) with respect to FIG. 7 correspond to the following cases (I), (II) and (III), respectively:

(I) When $f_B > (T+f_H)e^{\mu\theta}$, the recording sheet 30 slides on the cylindrical wall of the platen roller 1 in the direction of the force $f_B$.

(II) When $f_B < (T+f_H)/e^{\mu\theta}$ the recording sheet 30 slides on the cylindrical wall of the platen roller 1 in the direction of the force T.

(III) When $(T+f_H)/e^{\mu\theta} < f_B < (T+f_H)e^{\mu\theta}$, the recording sheet 30 will not slide being caught by the cylindrical wall of the platen roller 1.

That is, when $f_B$ is held in the range specified in (III), no slip occurs between the recording sheet 30 and the outer cylindrical wall (X-Y) of the platen roller 1. In this case, the recording sheet conveyance speed is $V_0$. Therefore, at the first recording sheet conveying section with the nip region X, local slip corresponding to the speed difference $V_H - V_0$ occurs between the recording sheet 30 and the platen roller which is locally driven at the recording sheet conveyance speed $V_H$. This slip absorbs the speed difference $V_H - V_0$, so that the force $f_H$ is provided at the first recording sheet conveying section with the nip region X. That is, the force $f_H$ is the maximum frictional force between the platen roller 1 and the recording sheet 30 at the first recording sheet conveying section with the nip region X. Similarly, at the second recording sheet conveying section with the nip region Y, a local slip corresponding to the speed difference $V_B - V_0$ occurs between the recording sheet 30 and the platen roller 1 which is locally driven at the recording sheet conveyance speed $V_B$. This slip absorbs the speed difference $V_B - V_0$, so that the force $f_B$ is provided at the second recording sheet conveying section with the nip region Y. That is, the force $f_B$ is the maximum frictional force between the platen roller 1 and the recording sheet 30 at the second recording sheet conveying section with the nip region Y. Hence, the forces $f_H$ and $f_B$ can be represented by the following equations:

$$f_H = \mu P_H$$

$$f_B = \mu P_B$$

These equations are substituted in the relation described in (III) above (hereinafter referred to as "relation (III)". Now, let us take forces $f_H$ and $f_B$ into consideration. Because of the material of the thermal head 9, in order to improve the printing quality it is necessary to limit $P_H$ to a certain value. The force of depression $P_B$ of the pinch roller 20 can be adjusted to a desired value; however, it is desirable that the range of adjustment is limited to several times in maximum. Therefore, the above-described relation (III) can be rewritten with respect to $P_B$ as follows:

$$(T/\mu + P_H)/e^{\mu\theta} < P_B < (T/\mu + P_H)\, e^{\mu\theta} \quad (4)$$

Next, it is assumed that the range of variation of the tensile force T applied to the recording sheet 30 by the clamper 10 is $T_{min} < T < T_{max}$ because of the torque variation of the torque limiter. In the range of variation of the tensile force T, the range of the force of depression $P_B$ of the pinch roller 20 with which no slip occurs between the recording sheet 30 and the cylindrical wall part X-Y of the platen roller 1 can be determined when the left side of equation (4) becomes maximum and the right side of equation 4 becomes minimum. Hence, from equation (4), $$(T_{max}/\mu + P_H)/e^{\mu\theta} < P_B < (T_{min}/\mu + P_H)\, e^{\mu\theta} \quad (5)$$

where $T_{max}$ is the maximum value of the tensile force acting on the recording sheet 30 by the clamper 10, $T_{min}$ is the minimum value of the tensile force acting on the recording sheet 30 by the clamper 10, $P_H$ is the force of depression of the thermal head 9, $\theta$ is the winding angle of the recoding sheet 30 on the platen roller 1 between the nip region of the pinch roller 20 and the platen roller 1 and the nip region of the thermal head 9 and the platen roller 1, $\mu$ is the frictional coefficient between the recording sheet 30 and the outer cylindrical wall of the platen roller 1, and e is the base of natural logarithm.

That is, selection of the force of depression $P_B$ of the pinch roller 20 in the range of relation (5) described above prevents the occurrence of slip between the recording sheet 30 and the platen roller 1 at the third recording sheet conveying section X-Y where the recording sheet 30 is wound on the platen roller 1. In other words, even when the tensile force acting on the recording sheet changes because of various factors, the recording sheet 30 is conveyed at a constant speed, being restrained by the third recording sheet conveying section X-Y.

For instance when, in the variation of the tensile force T applied to the recording sheet 30 by the clamper 10, $T_{min}=0$ and $T_{max}=2\ P_H$, and $\theta=120°$ and $\mu=0.8$, the range of $P_B$ is as follows:

$$0.65\ P_H,\ P_B < 5.34\ P_H$$

That is, the range is wide enough.

While the invention has been described with reference to the multi-color transfer type thermal printer, the same effects can be obtained by applying the technical concept of the invention to other type thermal printers.

As was described above, in the thermal printer of the invention, during printing, the pinch roller which is lower in the speed of rotation than the platen roller is urged against the platen roller through the recording sheet which is pulled in the direction of conveyance of the latter. Hence, the recording sheet is conveyed while being in close contact with the relatively large part of the outer cylindrical wall of the platen roller from the nip region of the pinch roller and the platen roller to the nip region of the thermal head and the platen roller. That is, no slip occurs between the outer cylindrical wall of the platen roller and the recording sheet. Accordingly, even if the tensile force applied to the recording sheet changes during printing, the speed of conveyance of the recording sheet is maintained unchanged. Thus, the thermal printer of the invention is free from color shift.

What is claimed is:

1. A sheet conveying apparatus comprising:

a platen roller having a cylindrical wall on which a recording sheet is wound, said platen roller conveying the recording sheet in a predetermined direction during printing;

a thermal head urged against said platen roller to heat heating points selected for transferring ink from an ink sheet onto the recording sheet;

sheet pulling means for pulling the recording sheet in said predetermined direction with a tensile force T that can vary between a maximum $T_{max}$ and a minimum $T_{min}$;

a pinch roller on a sheet supplying side engaged with said platen roller for urging the recording sheet against said platen roller with a predetermined force of depression $P_B$ so that the recording sheet is wound on said platen roller; and roller rotating means for rotating said pinch roller with a peripheral speed lower than that of said platen roller, wherein the predetermined force of depression $P_B$ is in a range in which it prevents the recording sheet from slipping with respect to the platen roller when the tensile force has any value between $T_{max}$ and $T_{min}$.

2. A sheet conveying apparatus as claimed in claim 1 wherein the force of depression $P_B$ of said pinch roller is in the following range:

$$(T_{max}/\mu+P_H)/e^{\mu\theta}<P_B<(T_{min}/\mu+P_H)e^{\mu\theta}$$

wherein $T_{max}$ is the maximum value of the tensile force acting on the recording sheet, $T_{min}$ is the minimum value of the tensile force acting on the recording sheet, $P_H$ is a force of depression of said thermal head, $\theta$ is the winding angle of the recording sheet on said platen roller between a nip region of said pinch roller and said platen roller and a nip region of said thermal head and said platen roller, $\mu$ is a frictional coefficient between the recording sheet and the cylindrical wall of said platen roller, and e is the base of the natural logarithm.

* * * * *

UNITED STATES PATENT AND TRADEMARK OFFICE

CERTIFICATE OF CORRECTION

PATENT NO. : 5,160,944

DATED : November 3, 1992

INVENTOR(S) : Fukumoto et al.

It is certified that error appears in the above-identified patent and that said Letters Patent is hereby corrected as shown below:

Column 4, line 1, change "1a" to --1a--.

Column 6, line 65, change "$T_1>T_2e^{\mu|0|}$" to --$T_1>T_2e^{\mu|\theta|}$--;

Column 6, line 68, change "$T_1>T_2e^{\mu|0|}$" to --$T_1>T_2e^{\mu|\theta|}$--.

Column 7, line 3, "$T_2/e^{\mu|0|}<T_1<T_2e^{\mu|0|}$" to --$T_2/e^{\mu|\theta|}<T_1<T_2e^{\mu|\theta|}$--.

Signed and Sealed this

Fifteenth Day of February, 1994

Bruce Lehman

*Attest:*

BRUCE LEHMAN

*Attesting Officer*

*Commissioner of Patents and Trademarks*